United States Patent [19]

Kanoi et al.

[11] Patent Number: 4,514,714

[45] Date of Patent: Apr. 30, 1985

[54] NOISE-REDUCTION DEVICE FOR STATIONARY INDUCTION APPARATUS

[75] Inventors: Minoru Kanoi, Ibaraki; Yasuro Hori, Katsuta; Yuzuru Kamata, Hitachi, all of Japan

[73] Assignee: Hitachi, Ltd., Tokyo, Japan

[21] Appl. No.: 466,485

[22] Filed: Feb. 15, 1983

[30] Foreign Application Priority Data

Feb. 20, 1982 [JP] Japan ..... 57-25241

[51] Int. Cl.[3] ..... H01F 15/00

[52] U.S. Cl. ..... 336/100; 181/202; 181/208; 188/379

[58] Field of Search ..... 336/100; 181/200, 202, 181/204, 207, 208, 286; 188/379, 380

[56] References Cited

U.S. PATENT DOCUMENTS 4,425,980 1/1984 Miles ..... 181/208
4,442,419 4/1984 Kanoi et al. ..... 336/100

FOREIGN PATENT DOCUMENTS 57-60815 4/1982 Japan .
57-60817 4/1982 Japan .

OTHER PUBLICATIONS

"Transformer Noise Abatement Using Tuned Enclosure Panels", report of 7th IEEE/PES Transmission and Distribution Conference and Exposition, Apr. 1-6, 1979, pp. 184-191.

*Primary Examiner*—Thomas J. Kozma
*Attorney, Agent, or Firm*—Antonelli, Terry & Wands

[57] ABSTRACT

A noise-reduction device for a stationary induction apparatus which device comprises a sound insulation panel attached to reinforcing channels provided at the periphery of a tank of the stationary induction apparatus so as to block noises emitted from the outer surface of the tank, a weighty body attached to the sound insulation panel for reducing vibrations of the sound insulation panel and a dynamic damper of which the natural frequency can be adjusted to be made equal to the vibration frequency of the weighty body so as to cancel the vibrations of the weighty body.

9 Claims, 8 Drawing Figures

NOISE-REDUCTION DEVICE FOR STATIONARY INDUCTION APPARATUS

The present invention relates to a noise-reduction device for reducing the noises generated from the tank of a stationary induction apparatus such as a transformer or reactor.

With the recent expension of urban areas and the resultant construction of residential housing near a power station or substation, there has been an increased demand for reducing the noises generated from stationary induction apparatuses such as, for example, the transformer. The noises of the stationary induction apparatuses are caused by the magnetostruction of the core which, in turn, causes electromagnetic vibrations to be transmitted to the tank through a medium such as, for example, oil and radiated into the atmosphere as a noise from the tank. Various measures have so far been taken to prevent such noises.

In one method, the transformer is installed in a soundproof building of concrete or steel plates to shut off or absorb the noises. This method has various disadvantages including an increased installation space of the stationary induction apparatus, an increased production cost and a lengthened construction period.

In, for example, Japanese Patent Publication No. 417/58 (Jan. 28, 1958), a simple noise-reduction method for stationary induction apparatuses overcoming the above-mentioned disadvantages is proposed wherein the noises are cancelled by a sound of the phase opposite to the noises of the stationary induction apparatus involved. This method, however, is not yet practically used in view of the fact that the noises generated by an induction apparatus, which is complicated in construction, include a plurality of frequency components, thereby making it necessary to provide separate loud speakers for different frequency components, with the result that an increased number of loud speakers are required and the adjustment of the frequency and sound volume is complicated.

A method to avoid this disadvantage is disclosed in U.S. patent application Ser. No. 279,814 now U.S. Pat. No. 4,435,751, wherein the vibrations generated in an induction apparatus are detected and the frequency components of the vibrations are determined by Fourier transformation, so that additional vibrations are applied in a manner to cancel the vibrations of the respective frequency components by vibrators mounted on the induction apparatus. This system also requires a number of vibrators as in the case of the above-mentioned Japanese Patent Publication. Further, vibrators of larger power are required to cancel the vibrations of the induction apparatus.

Co-pending U.S. patent application Ser. No. 406,564, filed Aug. 9, 1982 also discloses a system similar to the one disclosed in U.S. patent application Ser. No. 279,814, in which the phase and amplitude of the vibrations caused by the vibrators are advantageously adjusted; however, the above-mentioned problems, are not solved even by this suggested method.

Other conventional systems include, for example, U.S. patent application Ser. No. 217,772 now U.S. Pat. No. 4,371,858, wherein a sound-insulating plate is mounted on the framework such as a reinforcing channel on the outside surface of the tank through an elastic member thereby to reduce the noises produced from the tank, and Japanese Patent Laid-open No. 87306/81 entitled "Static Induction Apparatus" in which a similar sound-insulation panel is provided with a weighty material thereby to reduce the vibrations transmitted from the tank through the reinforcing channel to the sound insulation panel. Further, Japanese Patent Laid-open No. 60815/82 discloses an apparatus in which a highly damped plate is used for a sound insulation panel. Further, discussion is made about noise abatement in an article by Edward F. Ellingson entitled "Transformer Noise Abatement Using Tuned Enclosure Panels" in Report of 7th IEEE/PES Transmission and Distribution Conference and Exposition held on Apr. 1-6, 1979. The above methods have the disadvantage that although the noises (primary noises) radiated by way of the outer wall of the tank through the oil from the winding and core are capable of being reduced, it is impossible to reduce the noises (secondary noises) caused by the vibrations of the sound insulation panels in which the vibrations are transmitted from the outer wall of the tank through the reinforcing channel. In the latter method comprising a sound insulation panel and a weighty material combined which is intended to reduce the secondary noises, on the other hand, the noise reduction level is limited by the physical limitations of the strength or dimensions of the elastic member for carrying the sound insulation panels or the size of the weighty material.

Further, U.S. patent application Ser. No. 445,939, discloses a noise-reduction device in which a control force having a phase opposite to that of the vibration transmitted through reinforcing channels from a tank is applied by a vibration applying means to a weighty body. In this case, however, a power source for the vibration applying means is required, resulting in complexity in structure.

Further, Japanese patent application No. 60817/82 proposes a method for reducing vibrations with a simple structure and without requiring any power. In the proposed method, a plurality of dynamic dampers, each consisting of an elastic member and a weighty body, are attached to another weighty body attached to a sound insulation panel. The characteristic or natural frequency of each of the dynamic dampers is preliminarily set to be at an even number times the power source frequency so that the vibration of the weighty body attached to the sound insulation panel may be cancelled by the force of out of phase if the vibration frequency is an even number times the power source frequency. In practical cases, however, the natural frequency of each dynamic damper can not be exactly set to be an even number times the power source frequency due to scattering in manufacture of the dynamic damper even if the dynamic damper is manufactured such that the figure, weight, etc. of the dynamic damper are preliminarily determined by calculation to cause the natural frequency of produced dynamic damper to be an even number times the power source frequency. Thus, this method has a disadvantage that a difference may occur between the vibration frequency and the natural frequency to deteriorate the damping effect so that the vibrations can not be effectively reduced.

An object of the present invention is, therefore, to eliminate the prior art disadvantages as mentioned above and to provide a noise-reduction device for a stationary induction apparatus in which vibrations may be reduced with a simple structure and without requiring any power.

To attain this object, according to the present invention, each dynamic damper of the noise-reduction device is made bar-like and arranged as a beam between separated portions of a weighty body which is attached in the form of a frame onto a sound insulation panel, and each dynamic damper is arranged such that the natural frequency thereof may be readily adjusted from the outside of the apparatus.

The above and other objects, features and advantages of the present invention will be apparent when read the following detailed description of the preferred embodiments of the invention in conjunction with the accompanying drawings, in which.

Figure 1:
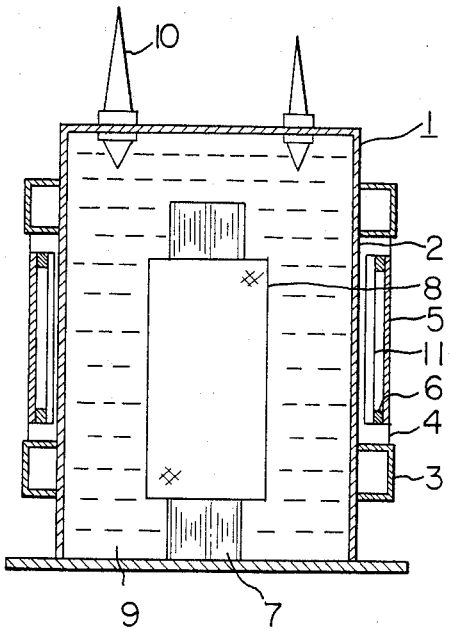
FIG. 1 is a cross-sectional front view the whole structure of the noise-reduction device for a transformer, according to an embodiment of the present invention.
Figure 2:
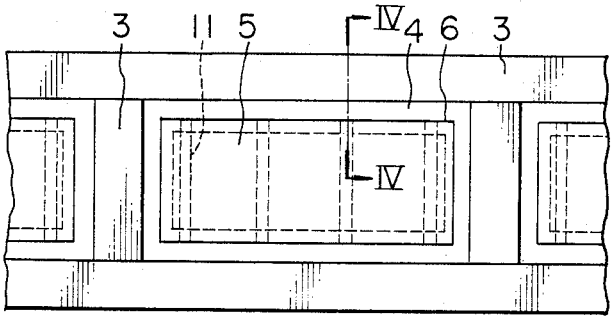
FIG. 2 is an enlarged side view of a main part of FIG. 1, illustrating the state of attachment of the reinforcing channels of the transformer, the weighty body, and the dynamic dampers.
Figure 3:
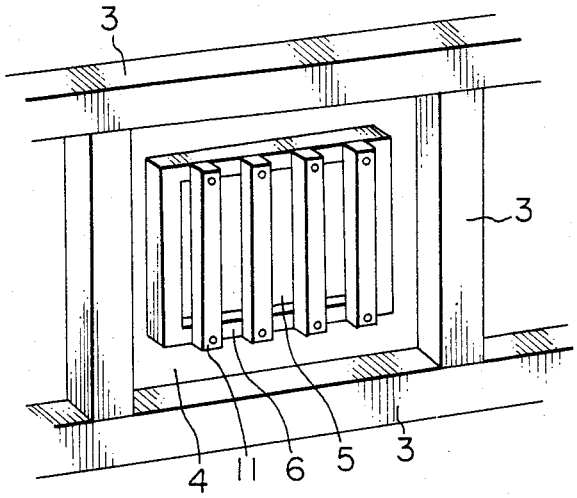
FIG. 3 is a perspective view of a main portion of FIG. 1 when viewed from the inside, for facilitating the understanding of the state of attachment of the reinforcing channels, the weighty body and the dynamic dampers.
Figure 4:
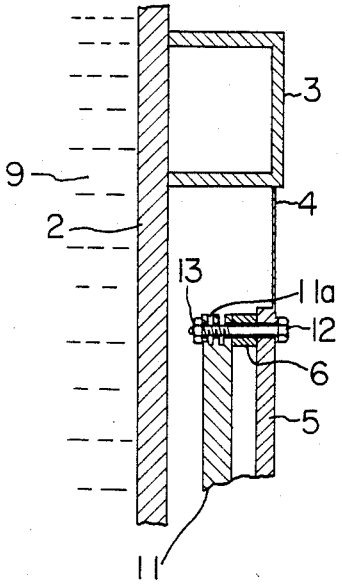
FIG. 4 is a cross-sectional view along lines IV—IV in FIG. 2, illustrating in more detail the state of attachment of the dynamic dampers.

Referring now to the drawings wherein like reference numerals are used throughout the various views to designate like parts and, more particularly, to FIGS. 1 and 2, according to these figures an embodiment of reinforcing channels 3 of a channel-section shape steel material are fixed in the form of a lattice by welding onto a side plate 2 of a tank 1 of a stationary induction apparatus so as to surround the circumference of the tank. An elongated thin steel plate 4 is welded to the outer circumferential edge of a sound insulation panel 5 substantially covering each of the windows formed by the latticed reinforcing channels 3. The thin steel plate 4 has a predetermined spring constant and is welded at its outer periphery to the reinforcing channels 3 at the inner circumferential edges of the window. A weighty body 6 in the form of a rectangular frame is fixedly attached onto the sound insulation panel 5 in the vicinity of the boundary between the thin plate 4 and the sound insulation panel 5. As shown in FIG. 3, a plurality of elongated dynamic dampers 11 made of, for example, a soft steel material are attached in parallel with each other between opposite portions respectively on the upper and lower sides of the rectangular frame of the weighty body 6. The apparatus further includes a base 7 iron cores and windings 8, insulation oil 9 filled in the tank 1, and busines 10 for lead wires. Each of the dynamic dampers 11 is preliminarily produced such that the natural frequency thereof is set by calculation to be a value slightly lower than the vibration frequency of the weighty body 6 provided on the sound insulation panel 5 which vibration frequency is one of high harmonics frequencies which are even numbers times the power source frequency. As is better shown in FIG. 4, each dynamic damper 11 is provided with slits 11*a* at its one end or opposite ends. A nut 13 is welded at the rear edge portion of each of the opposite ends of each dynamic damper 11 so that the dynamic damper 11 is attached to the weighty body 6 by adjusting bolts 12 each of which is externally inserted through loose holes provided through the sound insulation panel 5, the weighty body 6 and the dynamic damper 11 and threaded into the nut 13.

A method of adjusting the natural frequency of the elongated dynamic damper 11 will be now described. Generally, in the case where a body or object is supported by a spring which has a characteristic that the amount of deformation of the spring is non-linear with respect to the force externally applied thereto, the change in the amount of deformation of the spring causes a change in the spring constant, resulting in a change in the natural frequency of the body. The present invention utilizes this principle. In the above-mentioned embodiment, the dynamic damper 11 has a structure in which slits 11*a* are formed at either one end of or at both the opposite ends of a bar-like body. The slitted portion of this bar-like body forms a kind of spring having the above-mentioned characteristic of non-linearity, so that by adjusting the fastening force of the above-mentioned adjusting bolt 12 to adjust the force applied to the slitted portion to thereby adjust the amount of deformation thereat, the spring constant of the slitted portion may be changed in accordance with the change of the amount of deformation, resulting in a change in natural frequency of the dynamic damper per se.

Thus, the natural frequency of the dynamic damper 11, which has been set to be a value slightly lower than the desired one as described above, can be made equal to the vibration frequency of the weighty body 6 by externally rotating the adjusting bolt 12 in the direction to decrease the respective gaps of the slits 11*a* so as to gradually increase the natural frequency of the dynamic damper 11.

As stated in the description with respect to the prior art, vibrations may be transmitted, though small, to the sound insulation panel 5 in spite of the vibration-reduction function of the thin plate 4 and the weighty body 6. Reducing the vibration of the weighty body 6 to nearly zero, however, the vibration of the sound insulation panel 5 is made extremely small, resulting in the improvement in sound insulation effect of the sound insulation panel 5. In this embodiment, since the weighty body 6 is provided with the dynamic dampers 11 each having its natural frequency adjusted to be equal to the vibration frequency of the weighty body 6, the vibration of each dynamic damper 11 becomes maximum when the weighty body 6 vibrates so that a large reaction force corresponding to the vibration of the dynamic damper 11 is applied with antiphase to the vibration of the weighty body 6 to thereby extremely reduce the vibration of the weighty body 6, owing to the damping effect.

Figure 5:
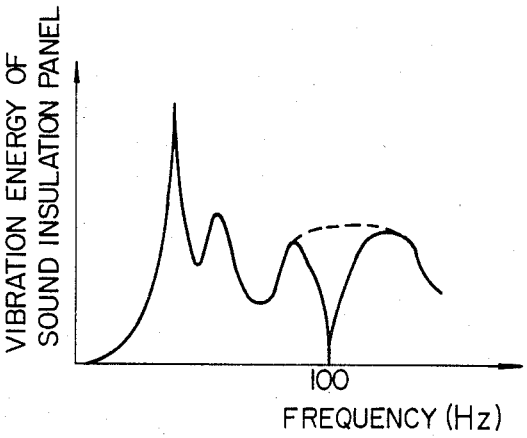
FIG. 5 is a graph showing vibration characteristics of the sound insulation panel when the dynamic dampers are attached and when no dynamic damper is attached.

In FIG. 5, the solid-line curve portion shows the vibration characteristic of the sound insulation panel to which dynamic dampers, each having a natural frequency adjusted to 100 Hz, attached thereto, and the broken-line curve portion shows the vibration characteristic, in the vicinity of 100 Hz, of the sound insulation panel having no dynamic damper attached thereto. As seen in FIG. 5, the vibration of the sound insulation panel 5 is sharply lowered at the natural frequency of the dynamic dampers (100 Hz in this example). Thus, if the natural frequency of each dynamic damper shifts even by a little value from 100 Hz, the vibration damping effect thereof may be inevitably deteriorated. Therefore, it is necessarily required to conduct a fine adjustment of the natural frequency of each dynamic damper. In the embodiment according to the present invention, this fine adjustment can be easily externally performed by means of the slits 11*a* provided at the end portion of each dynamic damper 11 and the adjusting bolt 12. That is, after the thin plate 4, the sound insulation panel 5, the weighty body 6 and the dynamic dampers 11 have been attached to the reinforcing channels 3, the adjusting bolt 12 for each dynamic damper 11 is externally gradually rotated in the direction to reduce the respective gaps of the slits 11*a* so that the end pieces at the slitted portion come close to each other to thereby gradually increasing the natural frequency of the dynamic damper 11 which has been set to a value slightly lower than the vibration frequency of the sound insulation panel 5, 100 Hz in this example, while externally watching the vibrating condition of the weighty body 6, until the vibration been minimized. When the vibration has become minimum, the adjusting bolt 12 is fixed at its position at that time so that the adjusting bolt 12 can not rotate thereafter. If necessary, the head of the adjusting bolt 12 may be cut off.

Figure 6:
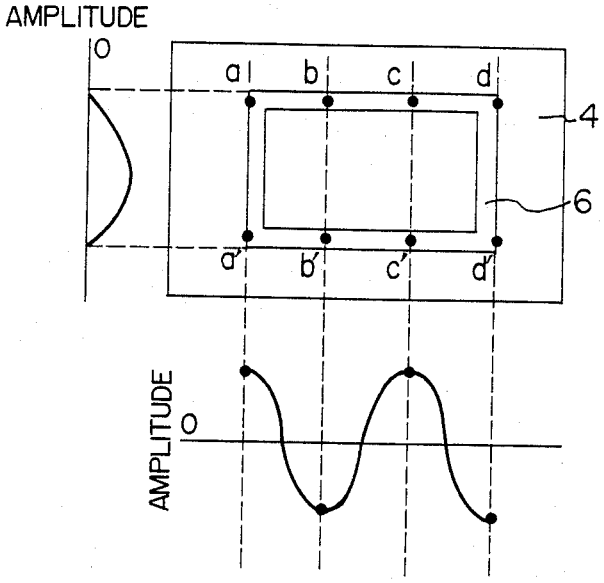
FIG. 6 is a characteristic diagram of the amplitude of vibrations at the respective positions of the weighty body.

FIG. 6 shows the status of amplitude of the vibration with respect to the respective positions of the weighty body 6, in the above-mentioned embodiment. The direction of the vibration is perpendicular to the plane of the drawing. Assuming in this embodiment that the vibration frequency of the weighty body is 100 Hz (the frequency of the power source of the apparatus being 50 Hz), the dimensions of the thin plate to which the weighty body is attached are 1,000 mm in length and 2,500 mm in width, and the weight of the weighty body is 5 kg, the weighty body may assume a vibration mode as shown in FIG. 6. In this case, the opposite sides of the weighty body 6 assume the same vibration mode. Accordingly, if the dynamic dampers are attached at the positions at which the amplitude of vibration becomes largest, the vibration can be effectively cancelled. That is, the vibrations at eight positions may be cancelled by attaching four elongated dynamic dampers at their ends to the points a and a′, b and b′, c and c′ and d and d′ of the weighty body 6 in FIG. 6. In this case, however, since both the outer end dynamic dampers attached across the opposite points a and a′ and b and b′, respectively, are in contact along their entire length with the corresponding sides of the weighty body to thereby deteriorate the vibration absorbing effect of these dynamic dampers, the outer end dynamic dampers are attached in a practical case at positions a little inside of the points a, a′ and d, d′. Even in this case, the dynamic dampers are effective because they are attached to the weighty body at the positions close to the largest vibration-amplitude points. The largest amplitude points can be easily obtained by dividing the length of each of the opposite transversely extending sides of the weighty body by the number of the positive and negative peaks of the vibration mode (in this embodiment the number being four because of the vibration mode of degree four).

Figure 7:
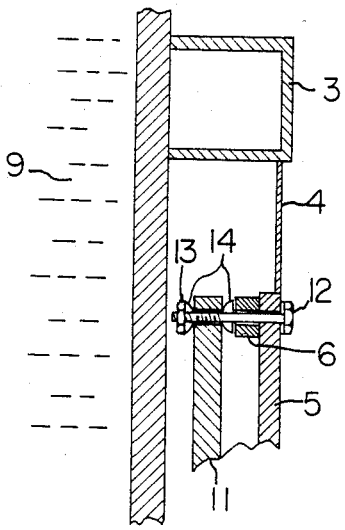
FIG. 7 is an enlarged cross-sectional view of a main part of another embodiment of the present invention, illustrating the state of attachment of the dynamic dampers.

In FIG. 7, each of the dynamic dampers 11, similar to that of the previous embodiment except without slits 11*a*, is attached to a weighty body 6, which is the same as that of the previous embodiment, through bolt 12 and nut 13 with two conical countersunk springs 14 at both sides of the damper 11, respectively, each spring having a non-linear characteristic. That is, in this case, the slitted portion of each dynamic damper 11 is replaced by the counter-sunk springs 14. Each of the elongated dynamic dampers 11 is preliminarily arranged such that the natural frequency thereof is a little lower than the vibration frequency of the weighty body 6. In adjusting, similarly to the previous embodiment, the adjusting bolt 12 is externally gradually rotated in the direction that the counter sunk springs 14 gradually pressed and deformed so as to change the spring constant to thereby gradually increase the natural frequency of the dynamic damper 11 until the natural frequency becomes equal to the vibration frequency of the weighty body 6.

There are the following advantages in each of the above-mentioned embodiments:

(1) Since the vibration of the weighty body 6 is reduced by the dynamic dampers 11, the sound insulating effect of the sound insulation plate 5 is increased to thereby improve the noise-reduction effect;

(2) Since each of the elongated dynamic dampers 11 are attached in the form of a beam across the upper and lower opposite sides of the weighty body 6 at the respective positions of the opposite sides at which the amplitude of vibration of the weighty body becomes maximum, vibrations at two positions of the weighty body 6 can be simultaneously reduced by each dynamic damper 11 so that the number of the dynamic dampers 11 can be reduced;

(3) Since the natural frequency of each of the dynamic dampers 11 can be externally adjusted under the condition that the dynamic damper is attached to the weighty body 6, the vibration of the weighty body 6 can be easily and surely reduced; and (4) The dynamic dampers 11 require no power, resulting in simplification in structure and in reduction in cost.

Figure 8:
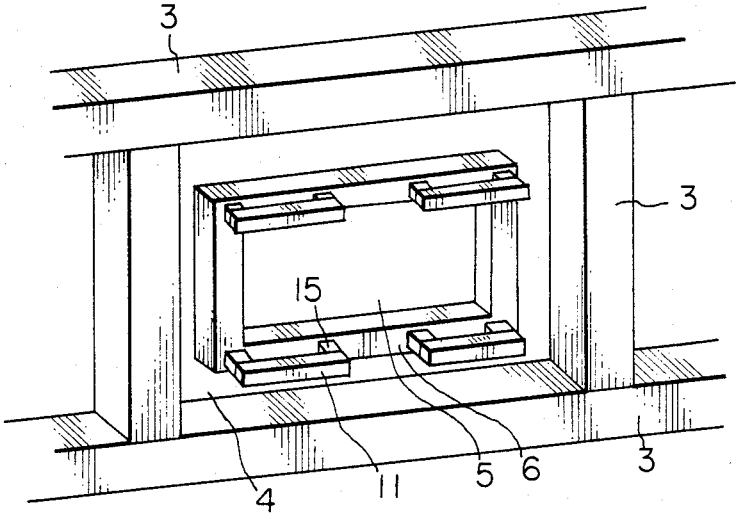
FIG. 8 is a perspective view of a main part of a further embodiment of the present invention, illustrating the state of attachment of the dynamic dampers to the weighty body.

The embodiment of FIG. 8 differs from each of the previous embodiments in the attaching positions of the dynamic dampers 11. In FIG. 8, the four dynamic dampers 11 are attached to the weighty body 6 between the points a and b, c and d, a′ and b′, and c′ and b′. That is a positive and a negative peak of amplitude of the vibration of the weighty body 6 are connected by each of the dynamic dampers 11. Each of the dynamic dampers 11 is attached to the weighty body 6 through a pair of metal pieces or spacers 15 to provide a gap between the dynamic damper 11 and the weighty body 6 so that the dynamic damper 11 can not be entirely in contact with the weighty body 6. Also in this case, the spring characteristic of the dynamic damper 11 may be provided by forming a slitted portion 11*a* similarly to the first-mentioned embodiment or by using a counter-sunk spring 14 similarly to the second-mentioned embodiment. In this embodiment, therefore, there are not only the same advantages as those in the previous embodiments but a further advantage that the number of the dynamic dampers 11 may be further reduced.

As the sound insulation panel, it is preferable to employ a highly damped plate of a plurality of thin steel sheets stacked and bonded to each other by a plastic material or welded by spot welding or a highly damped plate of a plastic material having a good sound-attenuating characteristic. In the case where the first-mentioned highly damped plate of a plurality of thin steel sheets is employed, one of the thin steel sheets may be extended so as to be directly welded to the reinforcing channels, so that the extended portion may be used as the above-mentioned thin plate having the spring characteristic.

As explained above, according to the present invention, since each of the dynamic dampers is attached to the weighty body at positions thereof separated from each other, the dynamic dampers require no power and may reduce vibrations of the weighty body with a simple structure to thereby improve in sound insulating effect of the sound insulation panel to realize further reduction in noises.

What is claimed is:

1. A noise-reduction device and a stationary induction apparatus which includes a tank filled with insulation oil and a substance of said induction apparatus mounted in said tank comprising:

a sound insulation panel provided at each of windows formed by reinforcing channels provided in the form of a latice surrounding the outer periphery of said tank, said sound insulation panel being supported by said reinforcing channels at each of said windows through a thin plate so as to substantially cover the concerned window;

a weighty body attached to the peripheral edge of said sound insulation panel in the vicinity of the boundary between said sound insulation panel and said thin plate for reducing vibrations of said sound insulation panel; and elongated dynamic dampers attached to said weighty body in a manner so that each of said dynamic dampers connects respective two of points of said weighty body at which the amplitude of vibration of said weighty body becomes substantially maximum, each of said dynamic dampers being provided with means for adjusting a natural frequency thereof.

2. A noise-reduction device and a stationary induction apparatus according to claim 1, in which said natural frequency adjusting means comprises a slitted portion provided at at least one of junction portions of said dynamic damper at which said dynamic damper is connected to said weighty body and a bolt for connecting said weighty body to said one junction portion, said bolt being arranged so that gaps at said slitted portion can be adjusted under the condition that said one junction portion is attached to said weighty body.

3. A noise-reduction device and a stationary induction apparatus according to claim 1, in which said natural frequency adjusting means comprises counter-sunk springs provided at at least one of junction portions of said dynamic damper at which said dynamic damper is connected to said weighty body for resiliently supporting said dynamic damper and a bolt for connecting said weighty body and said dynamic damper through said counter-sunk springs, said bolt being capable of adjusting the spring force of said counter-sunk spring under the condition that said dynamic damper is attached to said weighty body through said counter-sunk spring.

4. A noise-reduction device and a stationary induction apparatus according to claim 1, in which each of said dynamic dampers is attached across upper and lower opposite sides of a frame of said weighty body at portions of said opposite sides at each of which portions a positive peak of the amplitude of said vibration appears.

5. A noise-reduction device and a stationary induction apparatus according to claim 4, in which said natural frequency adjusting means comprises a slitted portion provided at at least one of junction portions of said dynamic damper at which said dynamic damper is connected to said weighty body and a bolt for connecting said weighty body to said one junction portion, said bolt being arranged so that gaps at said slitted portion can be adjusted under the condition that said one junction portion is attached to said weighty body.

6. A noise-reduction device and a stationary induction apparatus according to claim 4, in which said natural frequency adjusting means comprises counter-sunk springs provided at at least one of junction portions of said dynamic damper at which said dynamic damper is connected to said weighty body for resiliently supporting said dynamic damper and a bolt for connecting said weighty body and said dynamic damper through said counter-sunk springs, said bolt being arranged so as to be able to deform said counter-sunk springs under the condition that said dynamic damper is attached to said weighty body through said counter-sunk springs.

7. A noise-reduction device and a stationary induction apparatus according to claim 1, in which each of said dynamic dampers is attached across upper and lower opposite sides of a frame of said weighty body at portions of said opposite sides at which a positive and a negative peak of the amplitude of said vibration respectively appear.

8. A noise-reduction device and a stationary induction apparatus according to claim 7, in which said natural frequency adjusting means comprises a slitted portion provided at at least one of junction portions of said dynamic damper at which said dynamic damper is connected to said weighty body and a bolt for connecting said weighty body to said one junction portion, said bolt being arranged so that gaps at said slitted portion can be adjusted under the condition that said one junction portion is attached to said weighty body.

9. A noise-reduction device and a stationary induction apparatus according to claim 8, in which said natural frequency adjusting means comprises counter-sunk springs provided at at least one of junction portions of said dynamic damper at which said dynamic damper is connected to said weighty body for resiliently supporting said dynamic damper and a bolt for connecting said weighty body and said dynamic damper through said counter-sunk springs, said bolt being arranged so as to be able to deform said counter-sunk springs under the condition that said dynamic damper is attached to said weighty body through said counter-sunk springs.

* * * * *